US005277144A

United States Patent [19]

Moody

[11] Patent Number: 5,277,144

[45] Date of Patent: Jan. 11, 1994

[54] VALVE ASSEMBLY FOR SUBMARINE BALANCED EJECTION SYSTEM

[75] Inventor: Paul E. Moody, Barrington, R.I.

[73] Assignee: The United States of America as represented by the Secretary of the Navy, Washington, D.C.

[21] Appl. No.: 75,366

[22] Filed: Jun. 11, 1993

[51] Int. Cl.[5] ..... B63G 8/28

[52] U.S. Cl. ..... 114/319; 137/625.046; 114/316; 89/1.809

[58] Field of Search ..... 114/316-319, 238; 89/1.809-1.81; 137/625.46

[56] References Cited

U.S. PATENT DOCUMENTS 2,848,970 6/1958 Gunning ..... 114/319

5,165,360 11/1992 Moody ..... 114/319

*Primary Examiner*—Edwin L. Swinehart

*Attorney, Agent, or Firm*—Michael J. McGowan; Prithvi C. Lall; James M. Kasischke

[57] ABSTRACT

A valve assembly is provided for a submarine balanced ejection system including upper and lower launch tubes and upper and lower launch tube ejection systems, the assembly including a hull insert fixed in the pressure hull of the submarine and having first and second openings therein, a valve spool rotatably mounted and having ports therein selectively alignable with the first and second openings and with the upper and lower launch tubes and upper and lower launch tube ejection systems.

11 Claims, 6 Drawing Sheets

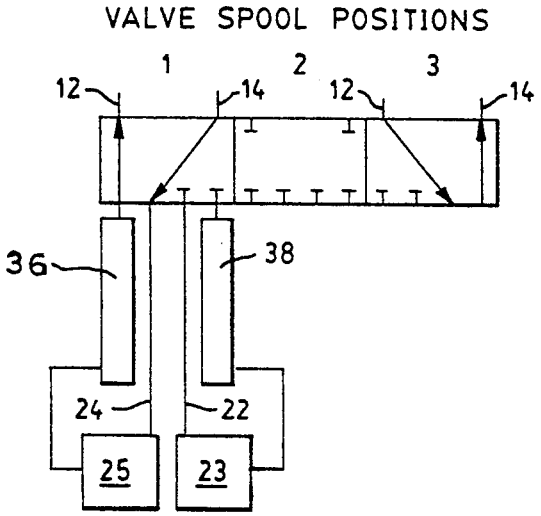
FIG. 7
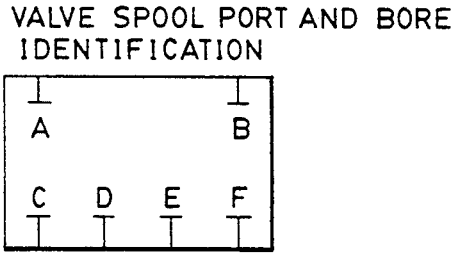
FIG. 6
| VALVE SPOOL POSITIONS | PORT AND BORE POSITIONS | | | | | |
|---|---|---|---|---|---|---|
| | A | B | C | D | E | F |
| 1 | OPEN TO SEA | CLOSED | OPEN TO ULT | OPEN TO ULTES & OPEN-ING 14 | CLOSED | CLOSED |
| 2 | CLOSED | CLOSED | CLOSED | CLOSED | CLOSED | CLOSED |
| 3 | CLOSED | OPEN TO SEA | CLOSED | CLOSED | OPEN TO LLTES & OPEN-ING 12 | OPEN TO LLT |
FIG. 8

VALVE ASSEMBLY FOR SUBMARINE BALANCED EJECTION SYSTEM

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION (1) Field of the Invention

This invention relates to submarine ejection systems, and is directed more particularly to a valve assembly for use therein.

(2) Description of the Prior Art

Prior art submarine ejection systems for launching devices, such as countermeasures or signal buoys, utilize a component which senses depth of the submarine. In response to the determined depth, pneumatic pressure in the ejection system is increased to a selected increment higher than the sea pressure at the determined depth. To accomplish ejection, high pressure air is ported to an ejection cylinder in which is disposed a piston which receives the high pressure air on one side thereof and moves in the cylinder to expel sea water on the other side thereof from the cylinder. The expelled water is ported to the breech of a launch tube. Inasmuch as the expelled water is at a higher pressure than outside sea pressure, a pressure differential occurs between the breech and muzzle ends of the device within the launch tube, launching the device from the tube.

Systems as described above suffer two disadvantages. Firstly, depth sensing and pressure compensation systems are not always reliable; and, secondly, bringing the high pressure air up to an appropriate pressure and rapidly releasing it results in a significant noise signature. As a submarine goes to deeper depths, higher air pressures are required to compensate for the deeper depth. The energy expended to obtain the air pressure required for deeper depths produces undesirable noise.

Recently proposed systems overcome the above-noted two disadvantages. The depth compensation system may be eliminated by utilizing a launch system, the operation of which is relatively independent from the depth of the submarine. This is accomplished by connecting a water cylinder/piston with an air cylinder/-piston, via a common shaft. As ejection air is ported into one side of the air piston, water is forced from one side of the water piston into the launch tube. As the water piston moves in a direction which forces water into the launch tube, water is drawn from sea to backfill the void which is created by the moving piston. As both sides of the water piston are subjected to sea pressure prior to, during, and following launch, the energy required to launch a device is proportional to the overpressure needed for device ejection and independent from sea pressure. As a fixed amount of energy is required to launch a device, regardless of the submarine depth, the launch system may have a minimal launch signature. The only disadvantage to this system is that a separate sea water feed must be provided to the water piston as it moves in a direction to effect a launch. This requires a separate hull penetration for each launch system utilized. One solution is to provide only one ejection system for two launch tubes. While this minimizes the number of hull penetrations required, it slows the rate at which one ejector can be fired after another, as the launch piston assembly must be returned to its at-battery position before it can be fired a second time.

A number of alternative launch systems have been proposed which may, in due course, replace the ram-pump system above described. These systems include an elastomeric bladder ejection system, an electromagnetic ejection system and a rotary pump ejection system. All these systems have the common characteristic of being pressure balanced and all require a separate hull penetration to back feed sea water which is displaced to effect a launch.

There is, therefore, a need for a submarine balanced ejection system valve assembly which will facilitate the use of one ejection system for two launch tubes, without the penalty of slow sequential launches from the two tubes and without requiring an additional hull penetration.

SUMMARY OF THE INVENTION

Accordingly, an object of the invention is to provide a valve assembly for a submarine balanced ejection system, the valve assembly being adapted to control two launch tubes and adapted to launch from the two tubes one after another in rapid fashion.

With the above and other objects in view, as will hereinafter appear, a feature of the present invention is the provision of a valve assembly for a submarine balanced ejection system including upper and lower launch tubes and upper and lower launch tube ejection systems. The assembly comprises a hull insert fixed in a pressure hull portion of the submarine, the hull insert having first and second openings therein, a valve spool disposed in an inboard recess in the hull insert. The valve spool is provided with a first port alignable with the first opening and a first launch tube to facilitate launch of a device through the first opening, a second port alignable with the second opening and a second launch tube to facilitate launch of a second device through the second opening, a third port adapted to be placed in communication with the second opening and the upper launch tube ejection system, and a fourth port adapted to be placed in communication with the first port and the lower launch tube ejection system. A spool cap is fixed to an inboard peripheral face of the hull insert, the spool cap having first and second bores therethrough, the first bore being adapted to be placed in communication with the upper launch tube and the first opening, and the second bore being adapted to be placed in communication with the lower launch tube and the second opening, the first launch tube being adjacent an inboard face of the spool cap and being aligned with the spool cap first bore, and the second launch tube being adjacent the inboard face of the spool cap and being aligned with the spool cap second bore.

The above and other features of the invention, including various novel details of construction and combinations of parts, will now be more particularly described with reference to the accompanying drawings and pointed out in the claims. It will be understood that the particular assembly embodying the invention is shown by way of illustration only and not as a limitation of the invention. The principles and features of this invention may be employed in various and numerous embodiments without departing from the scope of the invention.

BRIEF DESCRIPTION OF THE DRAWINGS

Reference is made to the accompanying drawings in which is shown an illustrative embodiment of the invention, from which its novel features and advantages will be apparent.

In the drawings:

FIG. 6 is a diagrammatic view serving to identify valve spool ports shown in FIG. 7;

FIG. 7 is a diagrammatic view showing the valve spool position; and

FIG. 8 is a chart showing port positions for various valve spool positions.

DESCRIPTION OF THE PREFERRED EMBODIMENT

Figure 1:
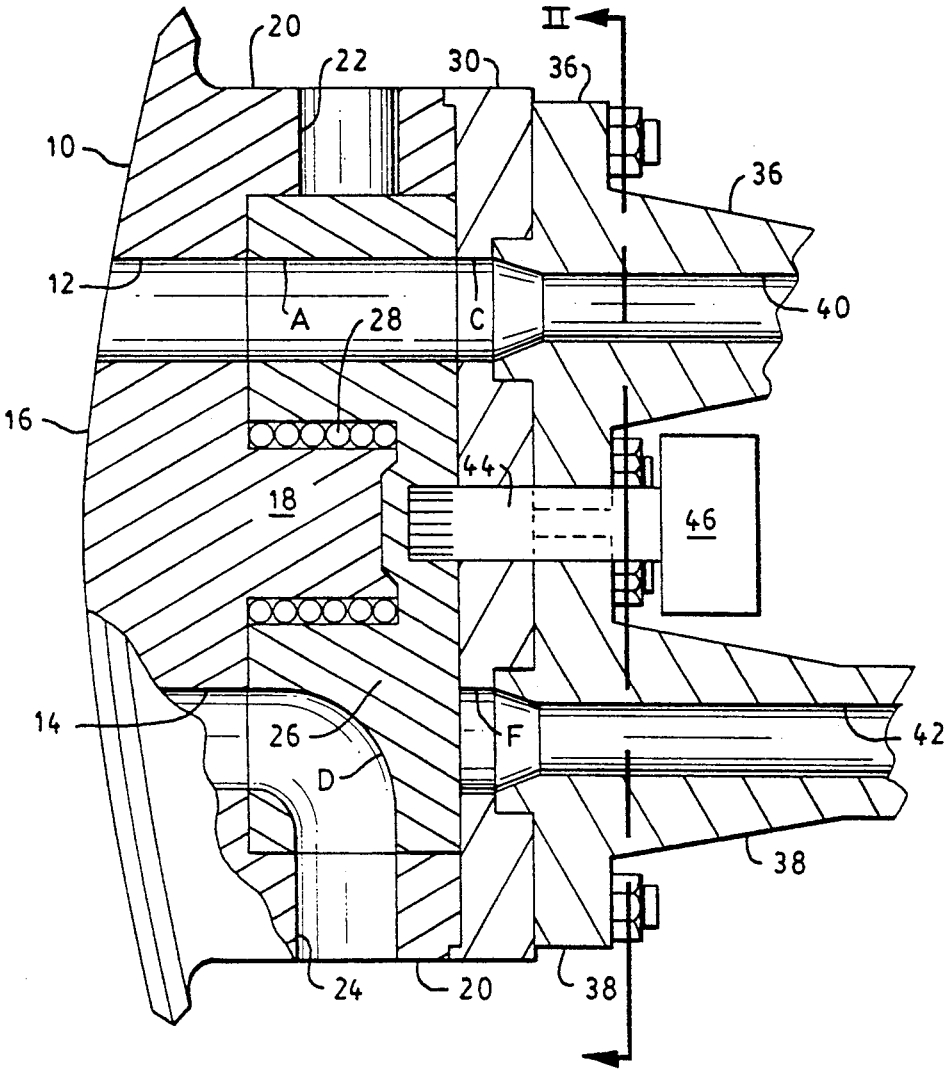
FIG. 1 is substantially a centerline sectional view of one form of a valve assembly illustrative of an embodiment of the invention.
Figure 2:
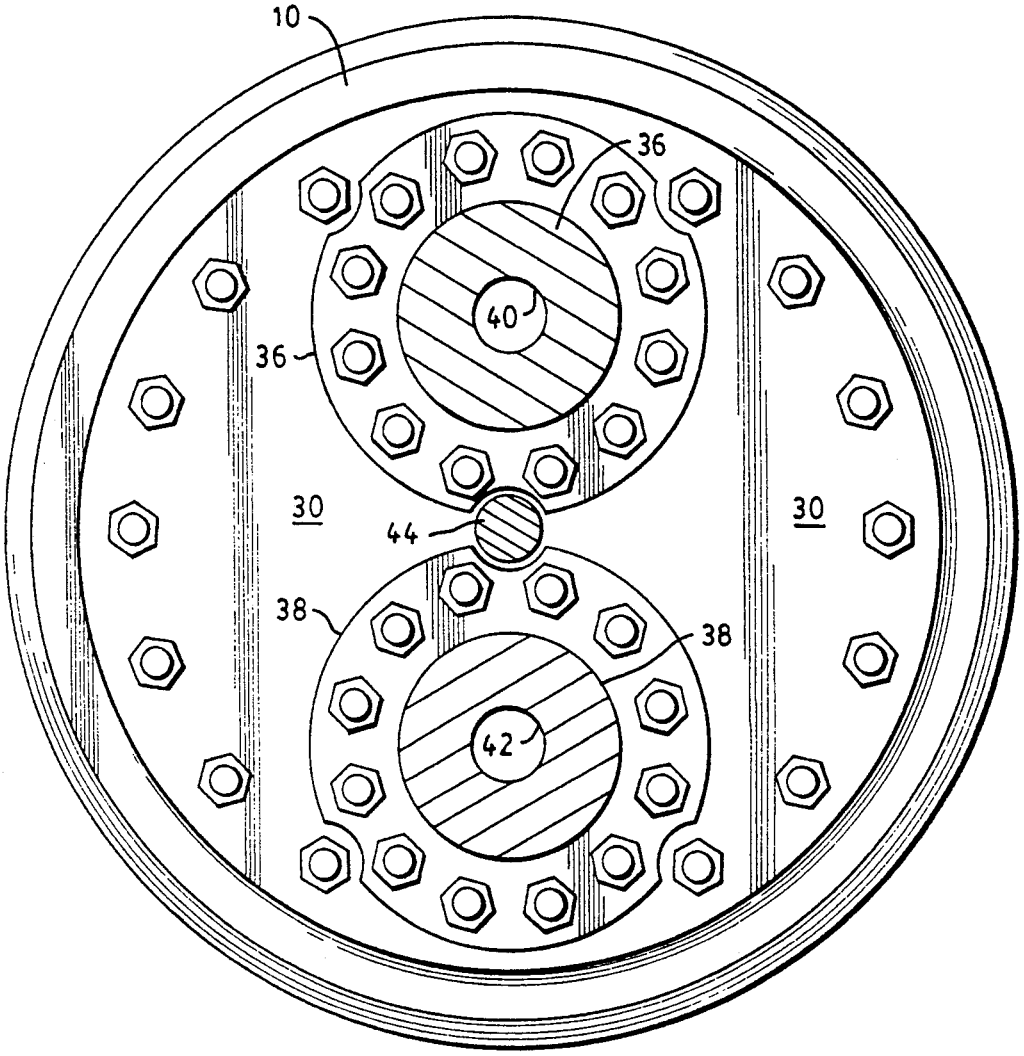
FIG. 2 is a sectional view taken along line II—II of FIG. 1.

Referring to FIGS. 1 and 2, it will be seen that the illustrative valve assembly includes a hull insert 10 which is fixed in the pressure hull of the submarine and has therein first and second openings 12, 14. The hull insert 10 is provided with a base portion 16, a hub portion 18, and an annular wall portion 20. The openings 12, 14 extend through base portion 16 of hull insert 10. Annular wall portion 20 of hull insert 10 is provided with a radially extending port 22 in communication with a lower launch tube ejection system (shown as 23 in FIG. 7), and a radially extending port 24 in communication with an upper launch tube ejection system, (shown as 25 in FIG. 7.)

Referring again to FIG. 1, the illustrative valve assembly further includes a valve spool 26 rotatably mounted on hull insert hub portion 18. Ball bearings 28, or the like, facilitate easy rotative movement of valve spool 26 on hub position 18. Valve spool 26 is provided with ports A and B (FIGS. 3–5) which extend straight through valve spool 26 and are adapted to be aligned, respectively, with openings 12 and 14, and ports D and E (FIGS. 3–5), which curve outwardly to connect with a launch tube ejector system, upper and lower, respectively. In FIG. 1, there is illustrated the alignment of port A and opening 12 and the alignment of port D and opening 14. This and other alignments are illustrated diagrammatically in FIG. 7.

As shown in FIG. 1, the assembly includes a spool cap 30 which may be fixed to annular wall portion 20 of hull insert 10 and is adjacent to valve spool 26. Spool cap 30 has therein bores C and F, in alignment, respectively, with openings 12, 14 in hull insert 10. Fixed to the assembly thus far described is an upper launch tube 36 and a lower launch tube 38. Each launch tube 36, 38 has therein a central passageway 40, 42, respectively.

As shown in FIGS. 1 and 2, a spline shaft 44 is fixed at a first end thereof to spool 26 and extends through spool cap 30. To the second end of spline shaft 44 there is connected a rotary activator 46 which is operative to rotate valve spool 26 on hull insert hub position 18. Thus, valve spool 26 is rotatably disposed in an inboard recess in hull insert 10, between hull insert 10 and upper and lower launch tubes 36, 38, and is movable to position the ports of valve spool 26 in selected alignments with openings and ports in hull insert 10 and upper and lower launch tubes 36, 38.

In FIG. 7, there are illustrated the various valve spool positions with the consequent alignments of ports (A,B,D,E) and bores (C,F). In FIG. 6, the various ports and bores shown in FIG. 7 are identified.

Figure 3:
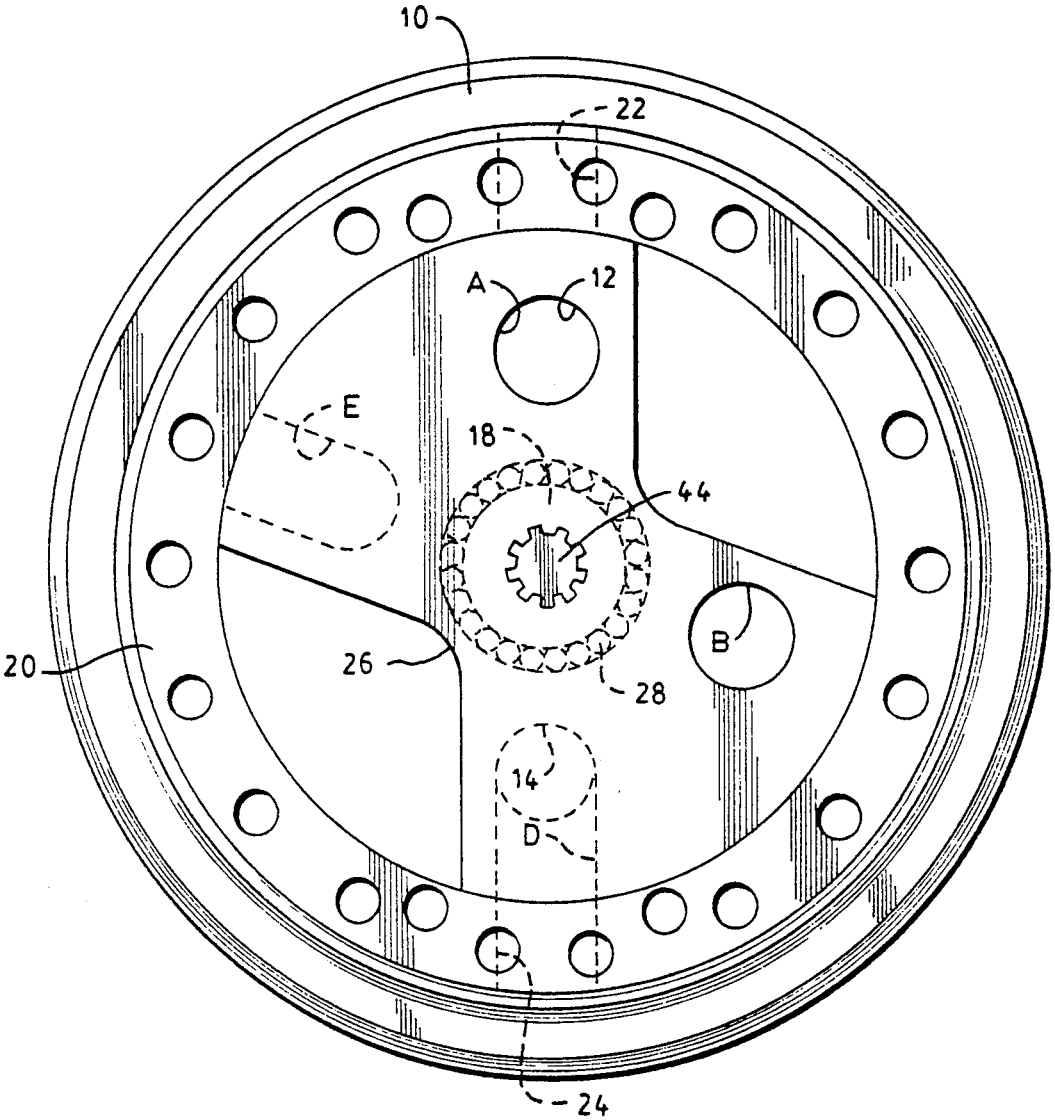
FIG. 3 is an elevational view of the valve assembly of FIGS. 1 and 2, with parts removed.

The position of valve spool 26, shown in FIG. 1, corresponds to the position of valve spool 26 shown diagrammatically in FIGS. 7 and 8 (spool position 1). That is, opening 12 is aligned with port A, which is in communication with bore C, which is in communication with upper launch tube 36; and opening 14 is aligned with port D which is in communication with port 24 which is in communication with the upper launch tube ejection system 25. FIG. 3 is similar to FIG. 2, but shows the assembly with launch tubes 36, 38 and spool cap 30 removed, exposing to view the valve spool 26.

In FIGS. 1–3, the assembly is shown in position for firing of the upper launch tube 36.

Figure 4:
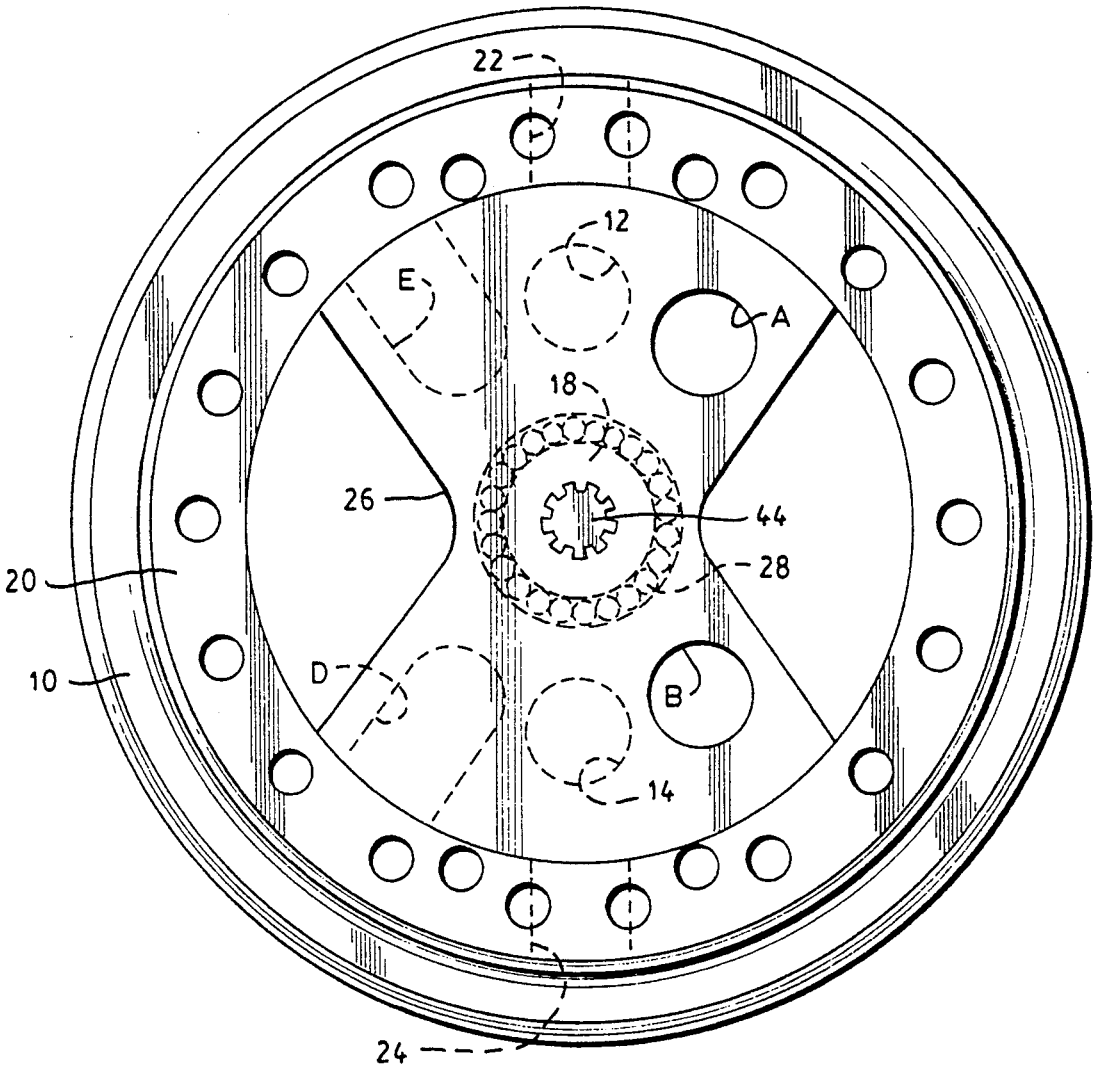
FIG. 4 is an elevational view similar to FIG. 3, but showing the valve assembly in an alternative position.

In FIG. 4, and in FIGS. 7 and 8 (spool position 2), there is shown the assembly with all ports closed and the system essentially shut down.

Figure 5:
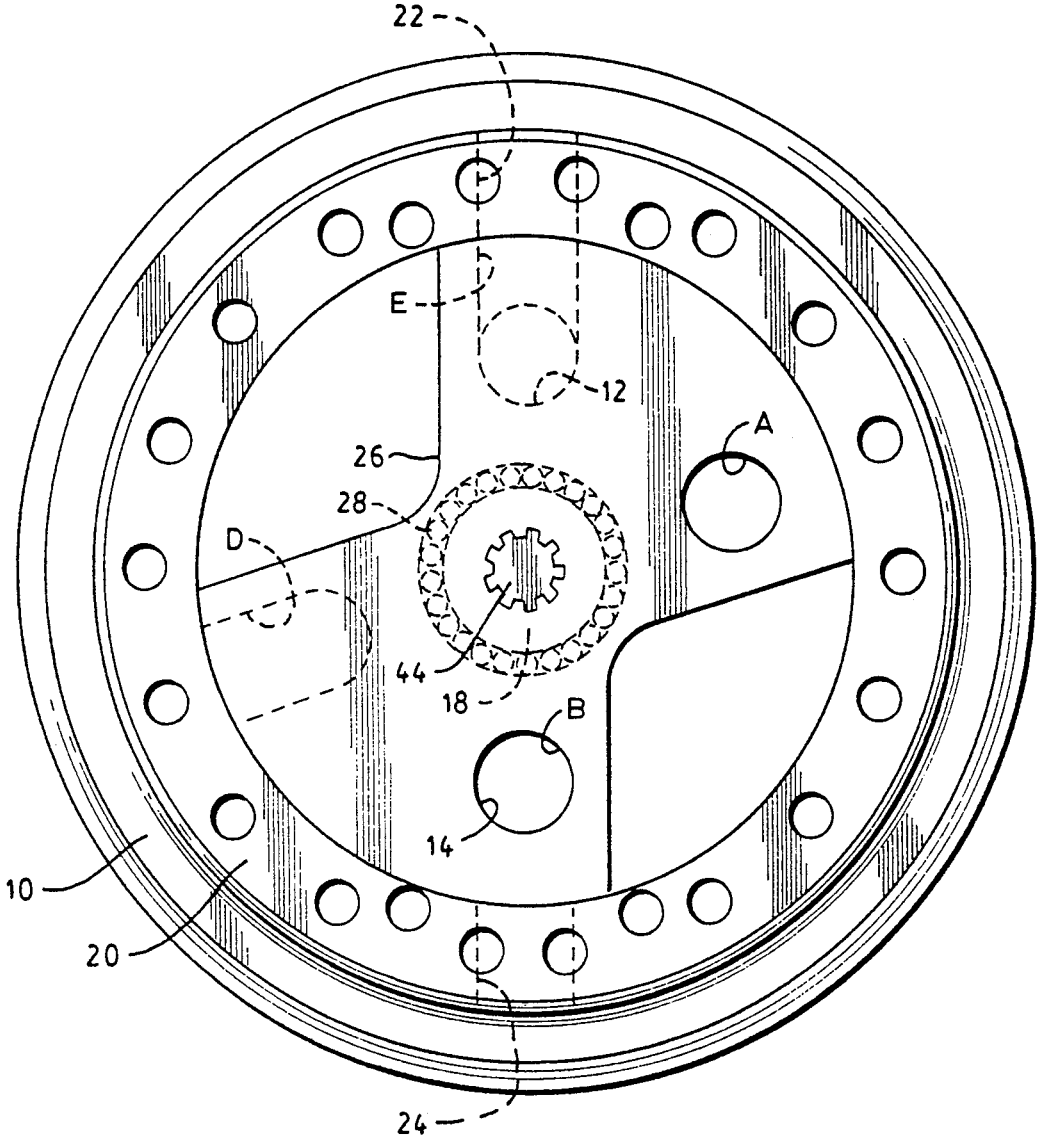
FIG. 5 is an elevational view similar to FIG. 4, but showing the valve assembly in another alternative position.

In FIG. 5, and in FIGS. 7 and 8, (spool position 3), there is shown the assembly in position for ejecting a device from the lower launch tube 38. The valve spool port B is aligned with hull insert opening 14 and spool cap bore F, which is in communication with lower launch tube 38. Bore C and port D are closed, isolating the upper launch tube 36 and upper launch tube ejection system 25. Valve spool port E is aligned with hull insert opening 12 and with hull insert port 22, which is in communication with lower launch tube ejection system 23.

The assembly shown and described herein preferably is located in the place normally occupied by launch tube muzzle seals, typically a ball valve for each tube. Each of the ports of the spool valve are provided with gasket seals held in place by retaining rings (not shown), as is known in the art.

In operation, the valve assembly in the position shown in FIGS. 1–3, and illustrated diagrammatically in FIGS. 7 and 8, provides a straight through bore 12, A, C, 40, through which a device may be launched from the upper launch tube 36. Simultaneously, the lower port D of the valve spool is positioned to provide a flow path through port 24 to the upper launch tube ejection system 25 (valve spool position 1 in FIGS. 7 and 8). In the positions shown in FIG. 5, the valve spool is positioned to provide a straight through bore 14, B, F, 42, through which a device may be launched from the lower launch tube 38. Simultaneously, the upper port 22 of the valve spool is positioned to provide flow through port E to the lower launch tube ejection system 23 (valve spool position 3 in FIGS. 7 and 8). Accordingly, the only hull penetrations required for the present system are those required for passage of launched devices from the submarine.

Thus, there is provided a valve assembly for use in a pressure balanced ejection system, requiring a minimum of hull penetrations and providing facility for rapid sequential launch. The single valve spool 26 dictates proper orientation of flow paths automatically. When either launch tube ejector system is readied by the valve to launch a device, the flow path to back fill the proper ejection system is automatically aligned.

It is to be understood that the present invention is by no means limited to the particular construction herein disclosed and/or shown in the drawings, but also comprises any modifications or equivalents within the scope of the claims. While the terms "upper" and "lower" have been used herein to describe launch tubes and launch tube ejector systems, such are merely terms of art commonly used in view of typical current submarine configurations. It will be apparent that in practice of the invention, the assembly herein described has equal applicability to launch tubes side by side.

What is claimed is:

1. A valve assembly for a submarine balanced ejection system including first and second launch tubes and first and second launch tube ejection systems, said assembly comprising:

a hull insert fixed in a pressure hull portion of said submarine, said hull insert having an inboard peripheral face, a first opening, a second opening and an inboard recess in said hull insert, said first and second openings being in communication with sea water;

a valve spool disposed in said inboard recess in said hull insert, said valve spool having a first port alignable with said first opening for launch of a device through said first opening, a second port alignable with said second opening for launch of a second device through said second opening, a third port adapted to be placed in communication with said second opening and said first launch tube ejection system, a fourth port adapted to be placed in communication with said first opening and said second launch tube ejection system; and a spool cap fixed to said inboard peripheral face of said hull insert, said spool cap having an inboard face, a first bore therethrough and a second bore therethrough, said first bore being adapted to be placed in communication with said first launch tube and said first opening, said second bore being adapted to be placed in communication with said second launch tube and said second opening;

said first launch tube being adjacent to said inboard face of said spool cap and being aligned with said spool cap first bore;

said second launch tube being adjacent to said inboard face of said spool cap and being aligned with said spool cap second bore.

2. The valve assembly in accordance with claim 1 wherein said valve spool is rotatably mounted between said hull insert and said spool cap.

3. The valve assembly in accordance with claim 2 wherein said valve spool is rotatable to a position in which said first port is aligned with said hull insert first opening, said second port is closed, said first bore is in communication with said first launch tube and said first opening, said third port is in communication with said second opening and said first launch tube ejection system, and said fourth port and said second bore are closed, whereby sea water is permitted to enter through said second opening and pass through said third port to said first launch tube ejection system to backfill said first launch tube ejection system upon launch of a device from said first launch tube.

4. The valve assembly in accordance with claim 2 wherein said valve spool is rotatable to a position in which said ports are closed.

5. The valve assembly in accordance with claim 2 wherein said valve spool is rotatable to a position in which said first port is closed, said second port is aligned with said hull insert second opening, said third port is closed, said fourth port is in communication with said first opening and said second launch tube ejection system, and said second bore is in communication with said second launch tube and said second opening, whereby sea water is permitted to enter through said first opening and pass through said fourth port to said second launch tube ejection system to backfill said second launch tube ejection system upon launching of a second device from said second launch tube.

6. The valve assembly in accordance with claim 3 wherein said first and second openings in said hull insert comprise portions of passageways through which said devices are ejected.

7. The valve assembly in accordance with claim 4 wherein said first and second openings in said hull insert comprise portions of passageways through which said devices are ejected.

8. The valve assembly in accordance with claim 5 wherein said first and second openings in said hull insert comprise portions of passageways through which said devices are ejected.

9. The valve assembly in accordance with claim 6 further comprising:

a spline shaft having a first and second end, said first end being fixed to said valve spool and said spline shaft extending through said spool cap; and a rotary activator fixed to said second end of said spline shaft and operative to turn said spline shaft and thereby said valve spool.

10. The valve assembly in accordance with claim 7 further comprising:

a spline shaft having a first and second end, said first end being fixed to said valve spool and said spline shaft extending through said spool cap; and a rotary activator fixed to said second end of said spline shaft and operative to turn said spline shaft and thereby said valve spool.

11. The valve assembly in accordance with claim 8 further comprising:

a spline shaft having a first and a second end, said first end being fixed to said valve spool and said spline shaft extending through said spool cap; and a rotary activator fixed to said second end of said spline shaft and operative to turn siad spline shaft and thereby said valve spool.

* * * * *